US007109829B2

(12) United States Patent
Kosaka et al.

(10) Patent No.: US 7,109,829 B2
(45) Date of Patent: Sep. 19, 2006

(54) FILTER CIRCUIT AND LAMINATE FILTER

(75) Inventors: Takeshi Kosaka, Nakamuroda Haruna-Machi (JP); Hisahiro Yasuda, Nakamuroda Haruna-Machi (JP)

(73) Assignee: Taiyo Yuden Co., Ltd., Tokyo (JP)

( * ) Notice: Subject to any disclaimer, the term of this patent is extended or adjusted under 35 U.S.C. 154(b) by 0 days.

(21) Appl. No.: 10/877,894

(22) Filed: Jun. 25, 2004

(65) Prior Publication Data

US 2004/0263288 A1 Dec. 30, 2004

(30) Foreign Application Priority Data

Jun. 30, 2003 (JP) ..... 2003-187484

(51) Int. Cl.
*H01P 1/203* (2006.01)

(52) U.S. Cl. ..... 333/204; 333/175

(58) Field of Classification Search ..... 333/175, 333/204, 203, 134, 202, 206
See application file for complete search history.

(56) References Cited

U.S. PATENT DOCUMENTS

| | | | | |
|---|---|---|---|---|
| 5,202,653 | A * | 4/1993 | Yamada et al. | 333/202 |
| 5,227,748 | A * | 7/1993 | Sroka | 333/207 |
| 5,351,020 | A | 9/1994 | Okamura et al. | |
| 5,374,909 | A * | 12/1994 | Hirai et al. | 333/204 |
| 5,412,358 | A * | 5/1995 | Hirai et al. | 333/204 |
| 5,896,073 | A * | 4/1999 | Miyazaki et al. | 333/204 |
| 6,177,853 | B1 * | 1/2001 | Nagatomi et al. | 333/204 |
| 6,597,259 | B1 * | 7/2003 | Peters | 333/134 |

FOREIGN PATENT DOCUMENTS

| | | |
|---|---|---|
| EP | 0 566 145 B1 | 8/1998 |
| JP | 08-023205 | 1/1996 |
| JP | 11-186808 | 7/1999 |
| JP | A 11-289205 | 10/1999 |
| JP | 2002-026607 | 1/2002 |
| JP | 2002-076705 | 3/2002 |

* cited by examiner

*Primary Examiner*—Seungsook Ham
(74) *Attorney, Agent, or Firm*—Knobbe Martens Olson & Bear, LLP

(57) ABSTRACT

Under circumstances where communication devices such as mobile phones are required to be diversified, laminate filters are required to have attenuation-band characteristics which are steep on both low-frequency and high-frequency sides. The prior-art laminate filter has the problem that an attenuation band is formed only on the low-frequency side or on the high-frequency side. A laminate filter has stripline patterns that are first, second, and third resonant elements disposed on a dielectric layer, a capacitively coupled (C-coupled) pattern disposed between the first and second stripline patterns, an inductively coupled (M-coupled) pattern disposed between the second and third stripline patterns.

20 Claims, 11 Drawing Sheets

(a)

(b)

FILTER CIRCUIT AND LAMINATE FILTER

This is a U.S. patent application claiming foreign priority under 35 U.S.C. § 119 to Japanese Patent Application No. 2003-187484, filed Jun. 30, 2003, the disclosure of which is herein incorporated by reference in their entirety.

BACKGROUND OF THE INVENTION

1. Field of the Invention

The present invention relates to a filter circuit and laminate filter used in a high-frequency range and, more particularly, to a filter circuit and laminate filter having attenuation bands on both low- and high-frequency sides.

2. Description of the Related Art

The principle of a conventional stripline filter is as follows. A stripline is disposed on a dielectric layer. One end of the stripline is short-circuited, the other end being open. This stripline filter adopts either an electric field-coupled type producing stronger electric field coupling or a magnetic field-coupled type producing stronger magnetic field coupling according to arrangement of resonators or by addition of capacitively coupled electrodes or the like. In the case of a filter in which the electric field coupling is stronger, there is a tendency of low-frequency attenuation. On the other hand, in the case of a filter in which the magnetic field coupling is stronger, there is a tendency of high-frequency attenuation.

Techniques disclosed in JP-A-H8-23205 (well-known example 1), JP-A-2002-26607 (well-known example 2), and JP-A-2002-76705 (well-known example 3) are examples of conventional techniques.

The fundamental embodiment disclosed in the well-known example 1 in the aforementioned prior-art examples comprises a first dielectric substrate 2 on which resonant electrodes 12*a* and 12*b* are formed, a second dielectric substrate 4 on which an internal grounding electrode 22 is formed, a third dielectric substrate 6 on which an external grounding electrode 16 is formed, and a fourth dielectric substrate 8 on which a capacitively coupled electrode 140 is formed, as shown in FIG. 1 of the reference. The degree of coupling is enhanced by an M-coupled electrode that is the internal grounding electrode 22 so as to adjust the frequency characteristics. An attenuation pole is formed by the capacitively coupled electrode. In this well-known example 1, the attenuation pole exists only in a low-frequency range as disclosed in FIG. 7 of the reference.

The fundamental embodiment disclosed in the well-known example 2 in the aforementioned examples is shown in FIG. 3 of the reference that is a virtual perspective view of the lamination of dielectric substrates 1*c* and 1*d*. In FIG. 3, the center-to-center spacing between resonator electrodes 11*a* and 11*b* is made coincident with the center-to-center spacing between notched capacitive electrodes 4*a* and 4*b*. In this way, when the amount of electromagnetic field coupling is controlled, it can be controlled by varying the length of a shared electrode portion 12 without changing the spacing. That is, the attenuation pole disclosed in FIG. 8 of the well-known example 2 is formed by the notched capacitive electrodes 4*a* and 4*b*. The stop band is controlled by varying the length of the shared electrode portion 12. In this well-known example 2, the attenuation pole exists only in a high-frequency range.

The fundamental embodiment disclosed in the well-known example 3 in the aforementioned well-known examples is shown in FIG. 2 of the reference. That is, dielectric layers 4*a*-4*d* are stacked. An upper electrode 5*b* is formed on the surface of the dielectric layer 4*a*. An end-surface electrode 5*c* is formed on the rear surface of the dielectric layer 4*d*. Striplines 1*a* and 1*b* are formed on the surface of the dielectric layer 4*c*. A shorting electrode 10 is formed in which one end of the each striplines 1*a* and 1*b* is connected substantially with the whole region of the end-surface electrode 5*c*. A stray capacitance electrode 9 is formed on the surface of the dielectric layer 4*b* perpendicularly to the striplines 1*a* and 1*b*. The attenuation band is adjusted by the stray capacitance electrode 9. The width of the high-frequency band is adjusted by the shorting electrode 5*c* that is M-coupled. Also, in this well-known example 3, the attenuation band exists only in a high-frequency range.

In any of the aforementioned well-known examples, both C-coupled and M-coupled patterns are provided to control the attenuation band. In these well-known examples, the controllable attenuation band is only on the low-frequency side (well-known example 1) or only on the high-frequency side (well-known examples 2 and 3).

Under circumstances where communication devices such as mobile phones are required to be diversified, laminate filters are required to have attenuation-band characteristics that are steep on both low- and high-frequency sides. In the conventional laminate filters, an attenuation band is formed only on the low-frequency side or high-frequency side as described above.

SUMMARY OF THE INVENTION

The present invention is intended to solve one or more of the foregoing problems. An object of the invention is to provide a filter circuit and laminate filter capable of coping with diversified communication devices by forming attenuation bands on both low-frequency and high-frequency sides.

The filter circuit of an embodiment of the present invention is intended to achieve the foregoing object. Embodiment 1 is a filter circuit fitted with first through third resonant elements which are connected with input/output lines. This filter circuit is characterized in that it comprises a capacitive parallel resonant circuit formed between the first resonant element and second resonant element and an inductive parallel resonant circuit formed between the second resonant element and third resonant element.

Embodiment 2 is based on Embodiment 1 and further characterized in that a capacitive or inductive multipath connects the capacitive parallel resonant circuit and the inductive parallel resonant circuit.

Embodiment 3 in the laminate filter of the present invention has stripline patterns that constitute first, second, and third resonant elements disposed on a dielectric layer, a capacitively coupled (C-coupled) pattern disposed between the first and second stripline patterns, and an inductively coupled (M-coupled) pattern disposed between the second and third stripline patterns.

Embodiment 4 is based on Embodiment 3 and further characterized in that a protruding portion protruding toward the third stripline pattern is formed on the capacitively coupled pattern.

Embodiment 5 has stripline patterns that constitute first through fourth resonant elements disposed on a dielectric layer, a first capacitively coupled (C-coupled) pattern disposed between the first and second stripline patterns, a second capacitively coupled (C-coupled) pattern disposed between the third and fourth stripline patterns, and an inductively coupled (M-coupled) pattern disposed between the second and third stripline patterns.

Embodiment 6 is based on Embodiment 5 and further characterized in that there are provided a capacitively coupled (C-coupled) pattern disposed between the second and third stripline patterns, a first inductively coupled (M-coupled) pattern disposed so as to connect the first and second stripline patterns, and a second inductively coupled (M-coupled) pattern disposed between the third and fourth stripline patterns.

Embodiment 7 is based on Embodiment 6 and further characterized in that protruding portions protruding toward the first stripline pattern and fourth stripline pattern, respectively, are formed on the capacitively coupled (C-coupled) pattern.

Embodiment 8 has stripline patterns that constitute first through third resonant elements formed on a first dielectric layer and stripline patterns that constitute fourth through sixth resonant elements formed on a second dielectric layer. The stripline patterns may be located opposite to each other with the first or second dielectric layer therebetween. The laminate filter may comprise: a capacitively coupled (C-coupled) pattern formed opposite to the first, second, fourth, and sixth resonant elements on a third dielectric layer disposed between the stripline patterns; and an inductively coupled (M-coupled) pattern disposed between the second and third resonant elements and between the fifth and sixth resonant elements.

Embodiment 9 is based on Embodiment 8 and further characterized in that there are further provided: stripline patterns that constitute seventh through ninth resonant elements and disposed so as to sandwich the first through third stripline patterns and second capacitively coupled (C-coupled) pattern therebetween; and a third inductively coupled (M-coupled) pattern disposed between the eighth and ninth resonant elements.

Element 10 comprises: microstrip line patterns that constitute first, second, and third resonant elements disposed on a dielectric layer; a capacitively coupled (C-coupled) pattern disposed between the first and second microstrip line patterns; and an inductively coupled (M-coupled) pattern disposed between the second and third microstrip line patterns. In all of the foregoing embodiments, any element used in an embodiment can interchangeably be used in another embodiment, and any combination of elements can be applied in these embodiments, unless it is not feasible.

For purposes of summarizing the invention and the advantages achieved over the related art, certain objects and advantages of the invention have been described above. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

Further aspects, features and advantages of this invention will become apparent from the detailed description of the preferred embodiments which follow.

BRIEF DESCRIPTION OF THE DRAWINGS

These and other features of this invention will now be described with reference to the drawings of preferred embodiments which are intended to illustrate and not to limit the invention.

DESCRIPTION OF THE PREFERRED EMBODIMENTS

As explained above, the present invention can be accomplished in various ways including, but not limited to, the foregoing embodiments. The present invention will be explained in detail with reference to the drawings, but the present invention should not be limited thereto.

Figure 1:
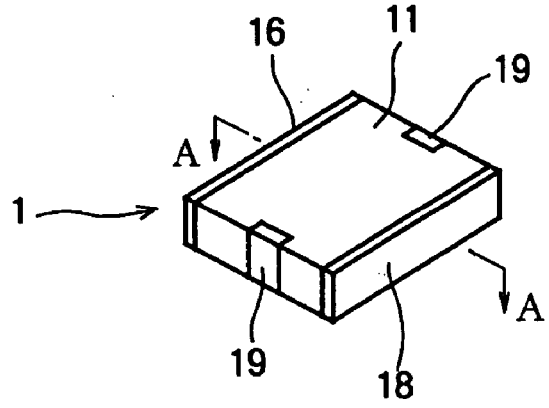
FIG. 1 is a perspective view showing the outer appearance of a laminate filter according to an embodiment of the present invention.
Figure 2:
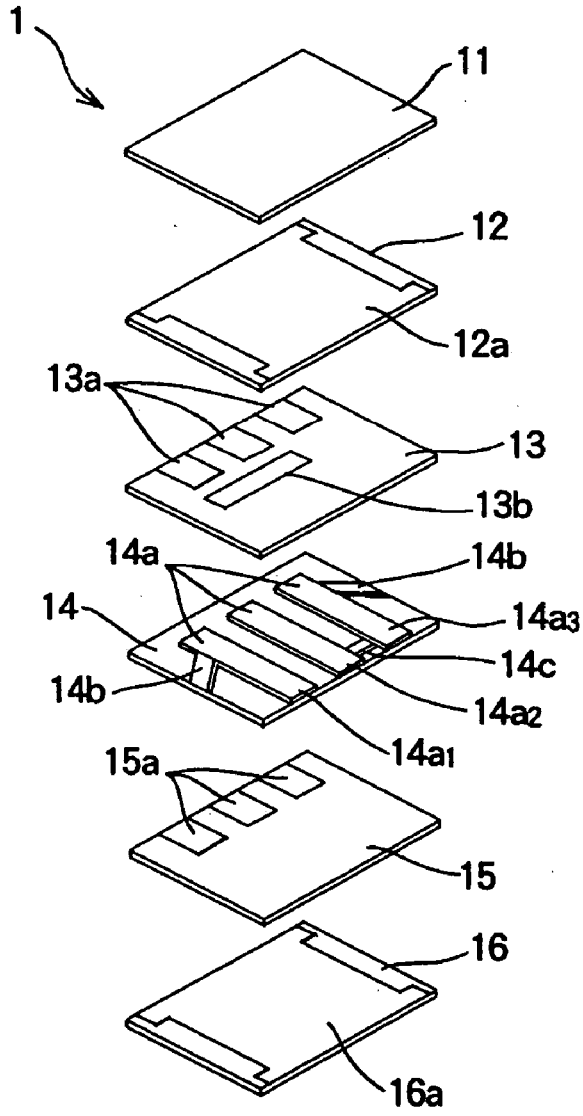
FIG. 2 is an explanatory perspective view showing the laminate structure of the filter in an embodiment.
Figure 3:
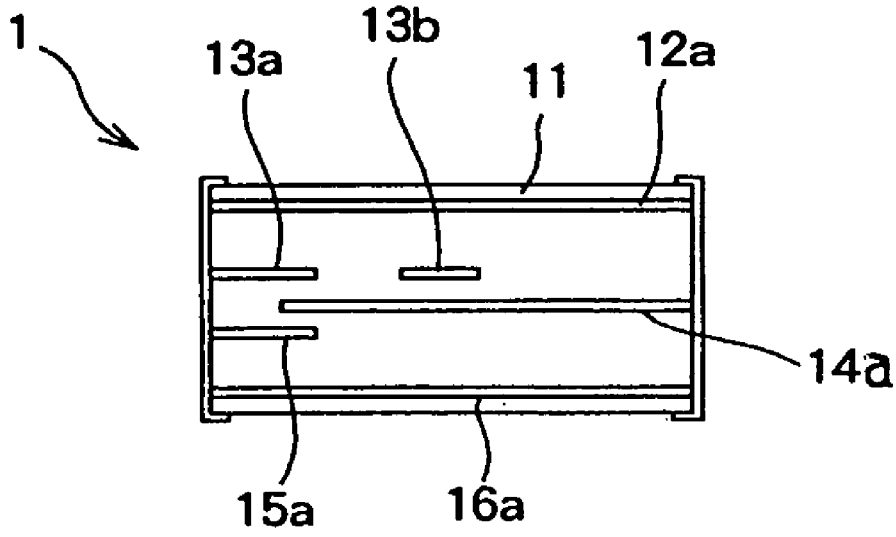
FIG. 3 is a cross-sectional view on line A—A of FIG. 1.
Figure 4:
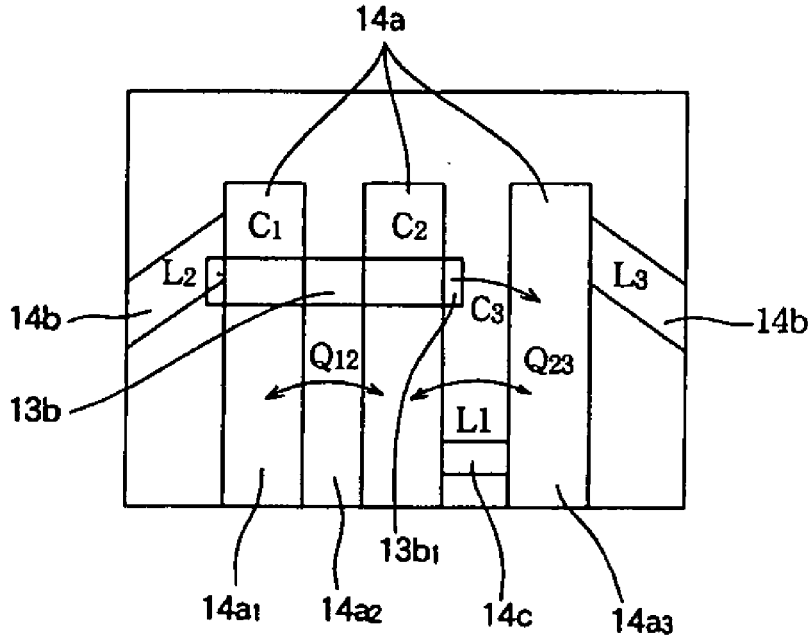
FIGS. 4(*a*) and 4(*b*) are perspective views showing the positional relation between patterns in FIG. 2.
Figure 4:
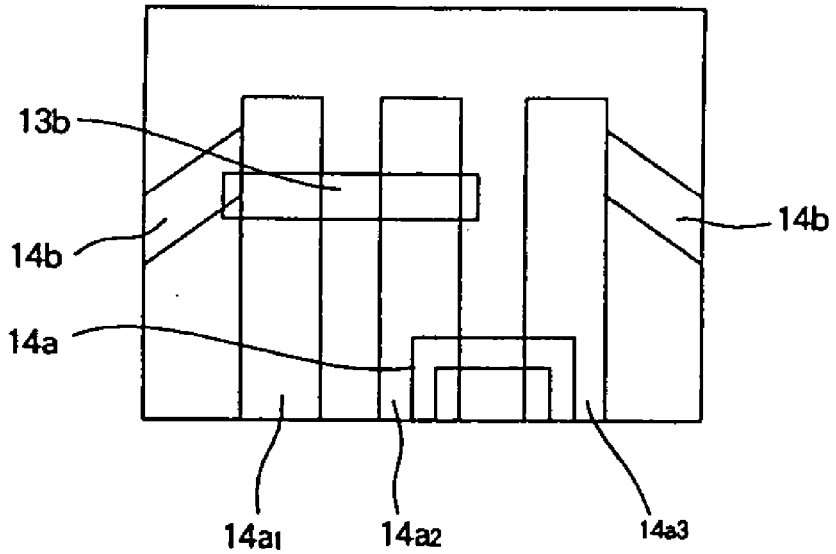
Figure 5:
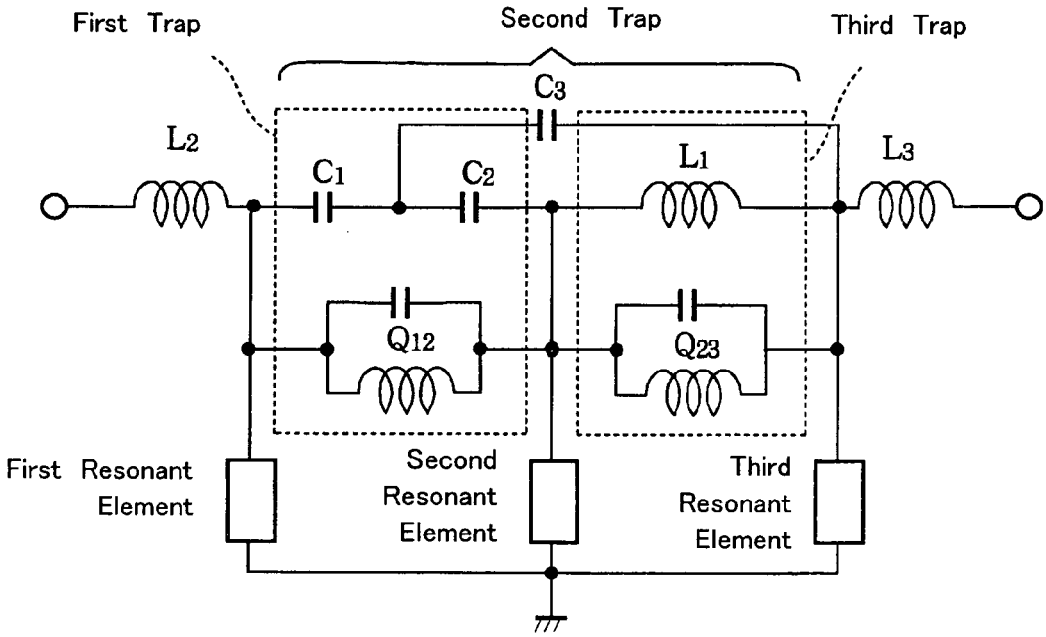
FIG. 5 is an equivalent circuit diagram.
Figure 6:
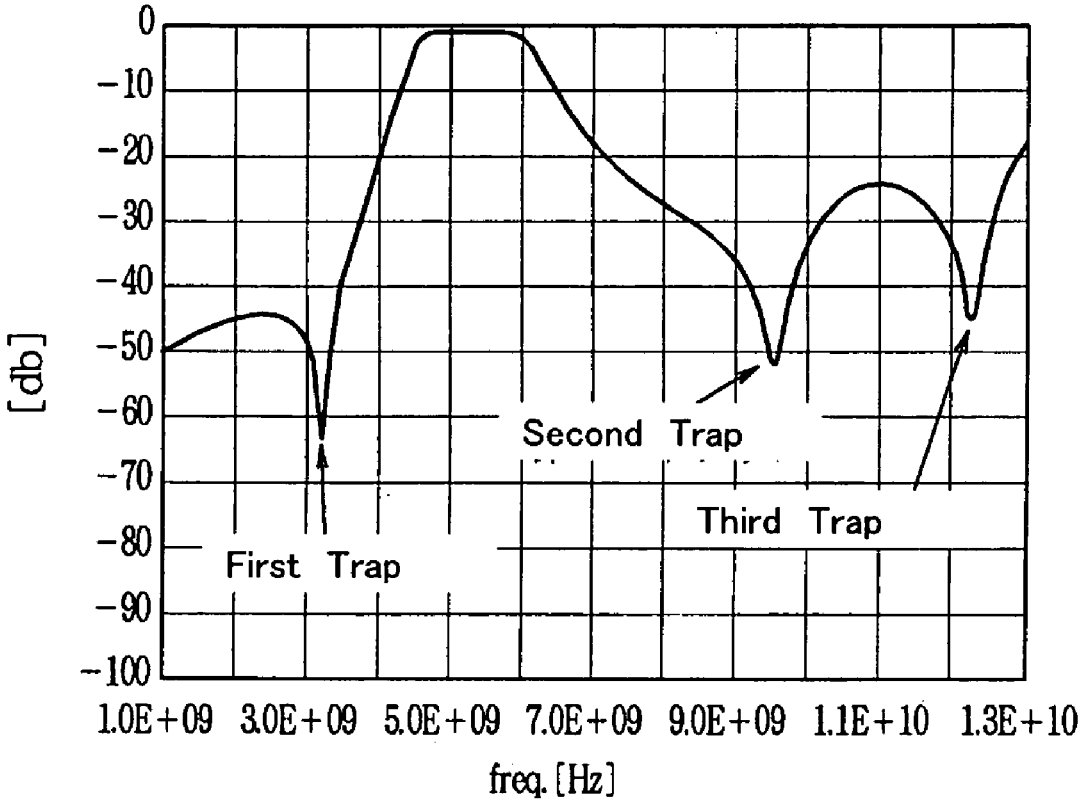
FIG. 6 is a frequency characteristic diagram owing to an equivalent circuit according to an embodiment of the invention.

A first embodiment of the laminate filter according to the present invention is hereinafter described with reference to FIGS. 1 to 5. FIG. 1 is a perspective view showing the outer appearance. FIG. 2 is an explanatory perspective view showing the laminate structure of the filter. FIG. 3 is a cross-sectional view taken on line A—A of FIG. 1. FIG. 4 is a perspective view showing the positional relation between patterns. FIG. 5 is an equivalent circuit. FIG. 6 shows the frequency characteristics obtained by a laminate filter according to an embodiment of the present invention.

As shown in FIG. 1, indicated by 1 is a laminate filter that is an integrated structure obtained by stacking plural dielectric layers 11 to 16 on which given conductive patterns are formed. The dielectric layers 11 to 16 are each made of a $BaTIOR_3$-based dielectric sintered ceramic body, for example. Patterns described below are formed on the dielectric layers 12 to 16.

As shown in FIG. 2, indicated by 11 is a first dielectric layer acting also as a protective layer. Indicated by 12 is a second dielectric layer on which a grounding pattern 12*a* is formed substantially over the whole area. Indicated by 13 is a third dielectric layer on which three internal grounding patterns 13*a* and a C-coupled pattern 13*b* parallel to the longer sides of the internal grounding patterns 13*a* at a position remote there from are formed, one end of each of the internal grounding patterns being exposed at one longer side thereof. Indicated by 14 is a fourth dielectric layer on which three parallel stripline patterns 14*a*, input/output patterns 14*b*, and an M-coupled pattern 14*c* are formed. Each of the stripline patterns 14*a* acts also as a resonator whose one end is exposed at the longer side thereof opposite to the first-mentioned longer side. One end of the input/output patterns 14*b* is connected with the first and third stripline pattern $\mathbf{14}a_1$ and $\mathbf{14}a_3$, respectively, of the stripline patterns 14*a*, the other end being exposed at the right and left shorter sides. The M-coupled pattern 14*c* connects the stripline patterns 14$a_2$ and 14$a_3$. Indicated by 15 is a fifth dielectric layer on which the same internal grounding patterns 15*a* as those of the third dielectric layer 13 are formed. Indicated by 16 is a sixth dielectric layer on which the same grounding pattern 16*a* as that of the second dielectric layer 12 is formed.

And, these dielectric layers 11 to 16 are stacked and integrated by a well-known method as shown in FIG. 1. The grounding pattern 12*a* on the second dielectric layer 2, the internal grounding patterns 13*a* on the third dielectric layer 13, the internal grounding pattern 15*a* on the fifth dielectric layer 15, and the grounding pattern 16*a* on the sixth dielectric layer 16 together form an external grounding conductive layer 16 at the longitudinal side surfaces while stacked on top of each other.

Furthermore, the grounding pattern 12*a* on the second dielectric layer 2, the stripline patterns 14*a* on the fourth dielectric layer 14, and the grounding pattern 16*a* on the sixth dielectric layer 16 together form an external grounding conductive layer 18 at the longitudinal side surfaces while stacked on top of each other. In addition, the input/output patterns 14*b* on the fourth dielectric layer 14 form an input/output conductive layer 19 at the lateral side surfaces (i.e., at the shorter sides) while stacked on top of each other.

The positional relation between the patterns having the dielectric layers 11 to 16 of FIG. 2 laminated thereon is shown in FIG. 4 in perspective. In this figure, the C-coupled pattern 13*b* overlaps the stripline patterns 14$a_1$ and 14$a_2$. The length of the C-coupled pattern 13*b* is so set that this pattern extends slightly beyond the stripline patterns 14$a_1$ and 14$a_2$. Especially, a protruding portion 13$b_1$, that is the C-coupled pattern 13*b* protrudes toward the stripline pattern 14$a_3$ from the stripline pattern 14$a_2$ is formed. This protruding portion 13$b_1$ becomes a multipath parallel resonant element (capacitive component C3) of an equivalent circuit described later.

An equivalent circuit of FIG. 4(*a*) is shown in FIG. 5. The M-coupled pattern 14*c* forms an inductance $L_1$ of the equivalent circuit. In FIG. 4, the left input/output pattern 14*b* forms an inductance $L_2$. Similarly, the right input/output pattern 14*b* forms an inductance $L_3$. Capacitances formed by the C-coupled pattern 13*b* and stripline patterns 14$a_1$, 14$a_2$are $C_1$and $C_2$. The protruding portion of the C-coupled pattern 13*b* and the stripline pattern 14$a_3$ are located opposite to each other with a dielectric layer therebetween to thereby form a capacitive component that becomes a multipath $C_3$. In addition, stripline patterns 14$a_1$ and 14$a_2$ together form $Q_{12}$ comprised of a capacitor and an inductance. The stripline patterns 14$a_2$ and 14$a_3$ together form $Q_{23}$ comprised of a capacitor and an inductance.

Note that FIG. 4(*b*) shows a U-shaped modification of the linear shape of the M-coupled pattern 14*c* of FIG. 4(*a*) described above. Other structures are exactly identical and so their description is omitted. The stripline patterns 14$a_1$to 14$a_3$form first through third resonators.

In the laminate filter constructed in this way, an equivalent circuit as shown in FIG. 5 is obtained. A capacitive parallel resonant circuit comprised of C1, C2, and Q12 is a circuit formed by an equivalent reactance in which the capacitive component produced between the first and second resonators is prevalent. The resonant frequency $f_0$ of the parallel resonant circuit is given by $$f_0=1/(2\pi\sqrt{LC})$$

so that, a first trap is formed in a low-frequency range of the frequency characteristics shown in FIG. 6.

A third trap is formed in a high-frequency range by an inductive parallel resonant circuit comprised of inductance L1 and Q23. A second trap is formed by adding a multipath parallel resonant circuit C3 to the capacitive parallel resonant circuit. The weaker side of the low- and high-frequency ranges can be made steeper by adjusting the frequency of the second trap.

The multipath parallel resonant element may be made by C-coupling (interlayer capacitive coupling) as in the above-described embodiment or L-coupling (connection by a pattern). In this way, in the above embodiment of the present invention, two traps are formed on the low- and high-frequency sides, respectively. Therefore, where one wants to secure the amounts of attenuation on both sides of a band, the embodiment of the present invention is effective.

Figure 7:
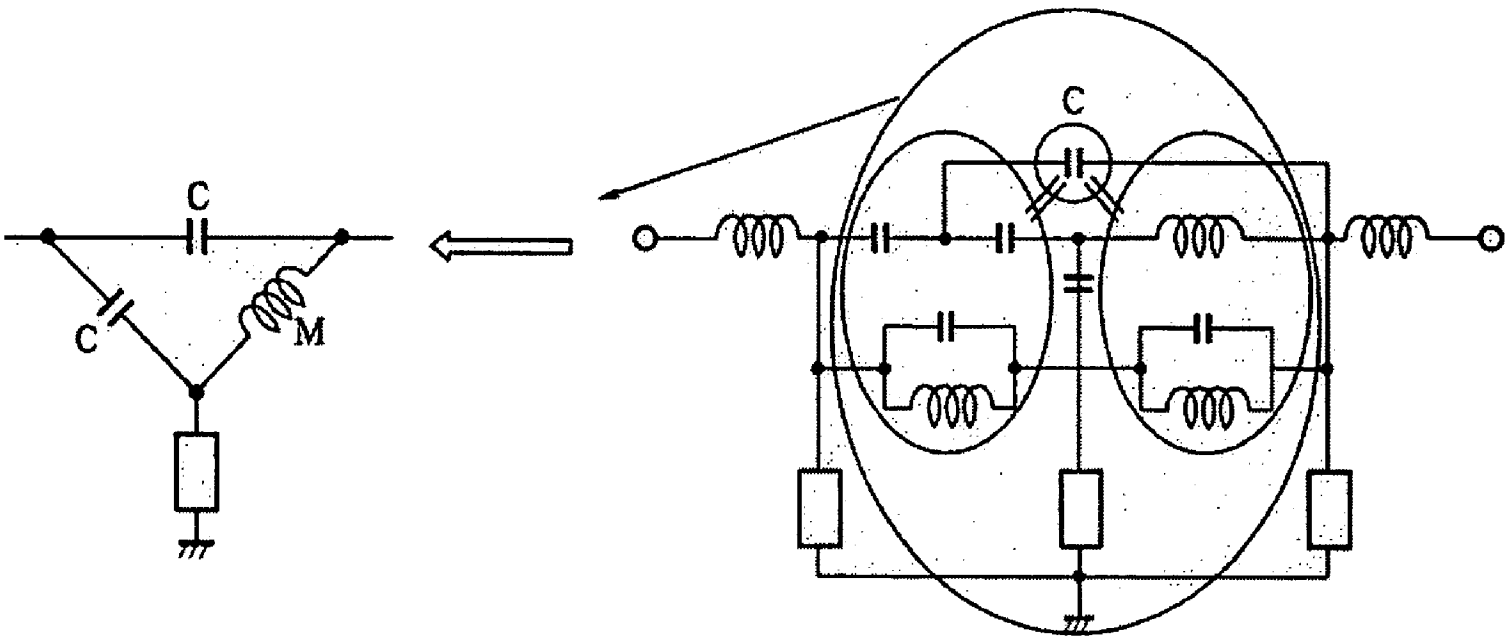
FIG. 7 is an equivalent circuit of FIG. 5.

The aforementioned multipath parallel resonant element can be considered equivalently as shown in FIG. 7. Therefore, the multipath parallel resonant element can be varied with less effects on other constants than other constants. The positions of the traps can be adjusted. Where one side shown in FIG. 7 is taken as M in which M-coupling is prevalent as in the aforesaid embodiment of the present invention, a trap appears on the high-frequency side. Where all the sides are taken as C, a trap appears on the low-frequency side. That is, the element is the conventional design in which traps do not appear on both low- and high-frequency sides.

Next, a second embodiment is described with reference to FIG. 8. The same patterns as those of the first embodiment described above are indicated by the same symbols and their description is omitted.

Figure 8:
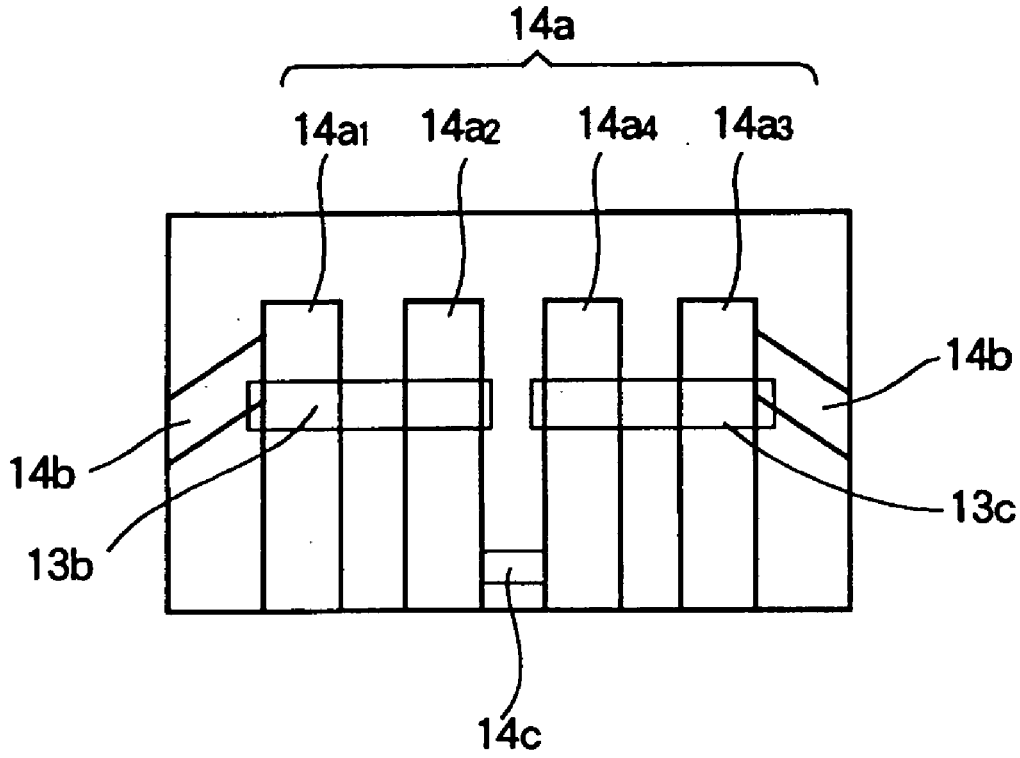
FIG. 8 is a perspective view showing the positional relation between patterns in a second embodiment.

In the embodiment of FIG. 8, a fourth stripline pattern 14$a_4$ that is a fourth resonant element is formed. A first C-coupled pattern 13*b* is formed on dissimilar dielectric layers across the first and second stripline patterns 14$a_1$ and 14$a_2$. A second C-coupled pattern 13*c* is formed on dissimilar dielectric layers across fourth and third stripline patterns 14$a_4$ and 14$a_3$. Furthermore, an M-coupled pattern 14*c* connecting second and fourth stripline patterns 14$a_2$ and 14$a_4$ is formed.

Also, in the laminate filter constructed in this way, first through third traps are produced in low-frequency and high-frequency ranges in the same way as the frequency characteristics shown in FIG. 6. This is effective where one wants to secure the amounts of attenuation on both sides of a band.

A third embodiment is next described with reference to FIG. 9. The same patterns as those of the above-described second embodiment are indicated by the same symbols and their description is omitted.

Figure 9:
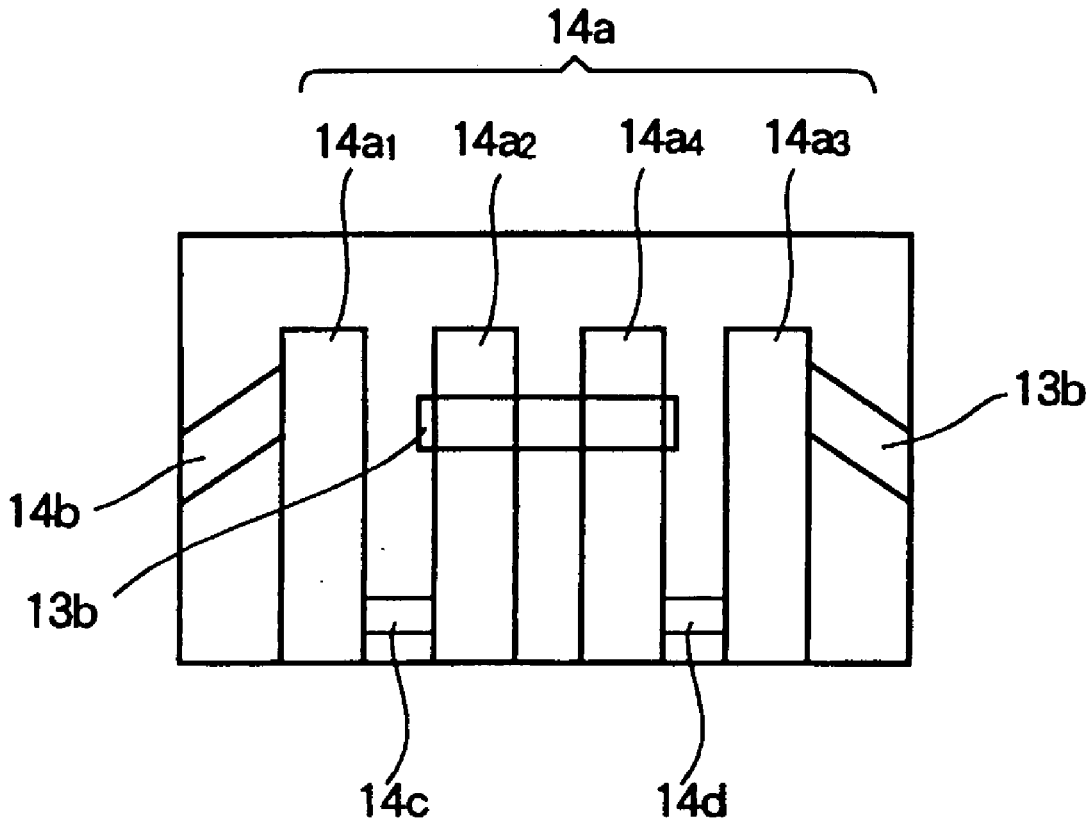
FIG. 9 is a perspective view showing the positional relation between patterns in a third embodiment.

In the embodiment of FIG. 9, a C-coupled pattern is formed on dissimilar dielectric bodies across second and fourth stripline patterns 14$a_2$ and 14$a_4$. Furthermore, a first M-coupled pattern 14*c* and a second M-coupled pattern 14*d* that connect first and second stripline patterns 14$a_1$, 14$a_2$ with fourth and third stripline patterns 14$a_4$, 14$a_3$, respectively, are formed.

A fourth embodiment is next described with reference to FIG. 10. The same patterns as those of the above-described third embodiment are indicated by the same symbols and their description is omitted.

Figure 10:
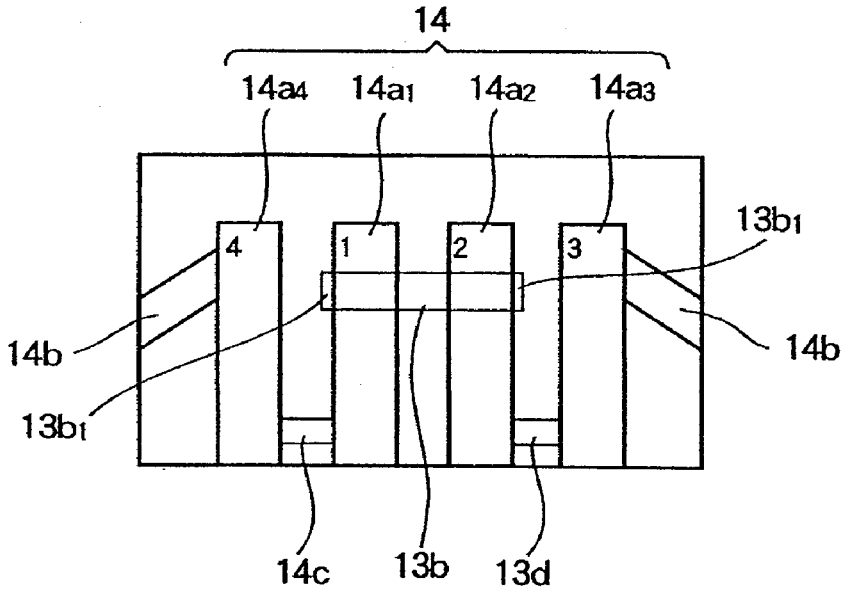
FIG. 10 is a perspective view showing the positional relation between patterns in a fourth embodiment.

In the embodiment of FIG. 10, protruding portions 13$b_1$ are formed in the C-coupled pattern 13*b* of FIG. 9 protruding oppositely to the fourth stripline pattern 14$a_4$ and third stripline pattern 14$a_3$. Roles of multipath parallel resonating elements are played between the protruding portions 13$b_1$ and respective ones of the fourth stripline pattern 14$a_4$ and third stripline pattern 14$a_3$. The two multipaths are formed by providing the protruding portions on both sides in this way. Consequently, more versatile pole formation and control are made possible.

A fifth embodiment is next described with reference to FIG. 11. The same patterns as those of the above-described first embodiment are indicated by the same symbols and their description is omitted.

Figure 11:
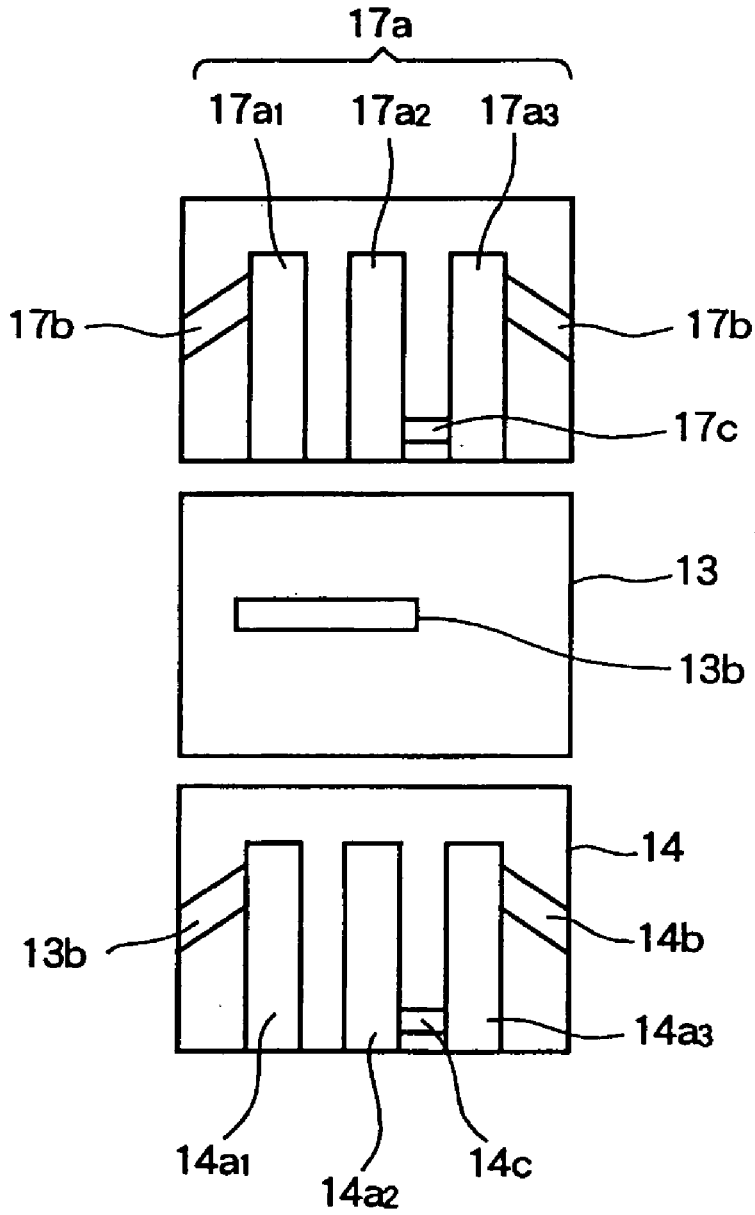
FIG. 11 is an explanatory perspective view showing the laminate structure in a fifth embodiment.

In the embodiment of FIG. 11, a seventh dielectric layer 17 having the same patterns as those of the fourth dielectric layer 14 is stacked on the upper surface side of the third dielectric layer 13 shown in FIG. 2 in the first embodiment such that the resonant patterns are opposite to each other.

That is, fourth through sixth stripline patterns 17$a_1$ to 17$a_3$ that are stripline patterns 17*a* are formed on the seventh dielectric layer 17. Input/output patterns 17*b* are formed on the fourth and sixth stripline patterns 17$a_1$ and 17$a_3$. A first M-coupled pattern 17*c* connecting the second and third stripline patterns 17$a_2$ and 17$a_3$ is formed. In addition, a dielectric layer 13 is formed on which a C-coupled pattern 13*b* is formed between the first through third stripline patterns and the fourth through sixth stripline patterns.

In this way, the C-coupled pattern is formed in the position sandwiched by the opposite stripline patterns. Therefore, effective capacitive coupling can be expected. Furthermore, the M-coupled patterns are formed on both dielectric layer 14 and dielectric layer 17. Consequently, in this opposite type laminate filter, too, both low- and high-frequency ranges can be attenuated effectively. It is to be understood that in an embodiment of the present invention, it is not impossible that an M-coupled pattern is formed only on the dielectric layer on one side.

A sixth embodiment is next described with reference to FIG. 12. The same patterns as those of the above-described fifth embodiment are indicated by the same symbols and their description is omitted.

Figure 12:
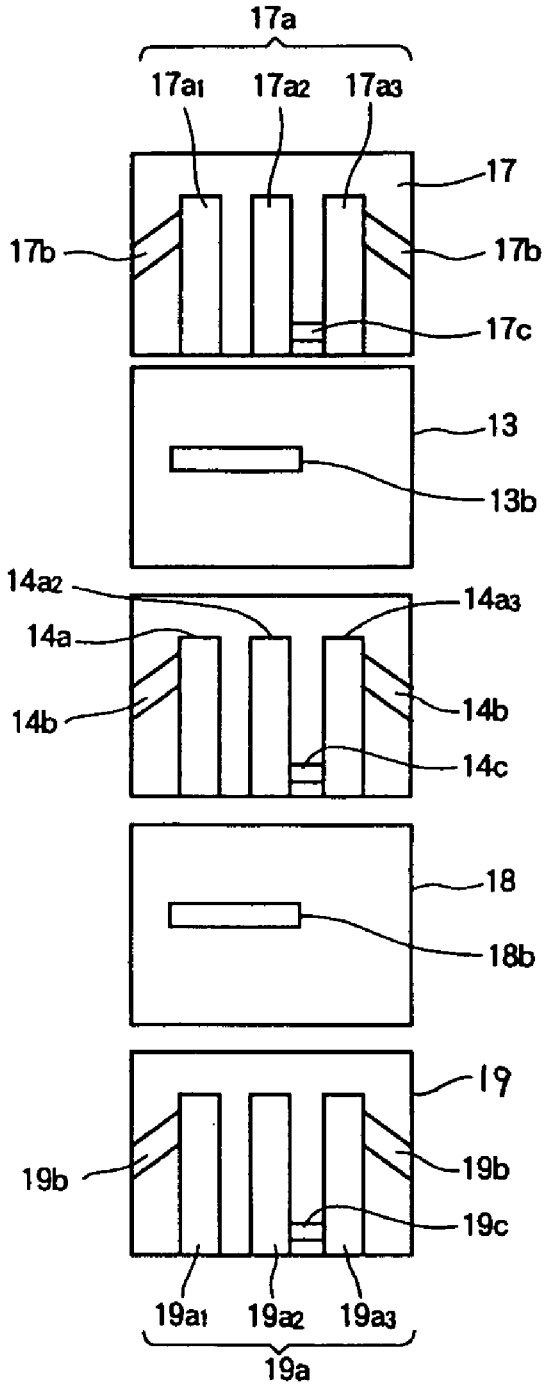
FIG. 12 is an explanatory perspective view showing the laminate structure in a sixth embodiment.

In the embodiment of FIG. 12, an eighth dielectric layer 18 having a second C-coupled pattern 18*b* is disposed under the fourth dielectric layer 14 in the fifth embodiment, the second C-coupled pattern 18*b* being formed at the same position as the C-coupled pattern 13*b* on the third dielectric layer 13 shown in FIG. 2. Furthermore, a ninth dielectric layer 19 on which seventh through ninth stripline patterns 19$a_1$ to 18$a_3$, input/output patterns 19*b*, and a third M-coupled pattern 19*c* are formed is stacked under the eighth dielectric layer 18. The seventh through ninth stripline patterns 19$a_1$ to 18$a_3$ are stripline patterns 19*a* that are the same patterns as those of the fourth and seventh dielectric layers 14 and 17.

Also, in the laminate filters shown in these third through sixth embodiments, first through third traps are produced in both low- and high-frequency ranges in the same way as in the frequency characteristic diagram shown in FIG. 6. This is effective where one wants to secure the amounts of attenuation on both sides of a band.

In the above embodiments, laminate filters are taken as examples. The present invention can also be applied to a filter circuit fabricated on a printed wiring board and also to a microstrip line filter fabricated by forming a microstrip line pattern on a multilayer substrate.

As described above, in an embodiment of the present invention, a filter circuit in which first through third resonant elements are connected with input/output lines includes: a capacitive parallel resonant circuit formed between the first resonant element and second resonant element; and an inductive parallel resonant circuit formed between the second resonant element and third resonant element. Consequently, attenuation bands are formed in both low-and high-frequency ranges. Hence, the filter circuit can cope with a communication device in which it is required to secure the amounts of attenuation on both sides of a band.

It will be understood by those of skill in the art that numerous and various modifications can be made without departing from the spirit of the present invention. Therefore, it should be clearly understood that the forms of the present invention are illustrative only and are not intended to limit the scope of the present invention.

What is claimed is:

1. A filter circuit comprising first through third resonant elements connected with input/output lines, said filter circuit comprising:

a capacitive parallel resonant circuit formed between said first resonant element and said second resonant element; and an inductive parallel resonant circuit formed between said second resonant element and said third resonant element, wherein a capacitive or inductive multipath connects said capacitive parallel resonant circuit and said inductive parallel resonant circuit.

2. A laminate filter comprising:

first, second, and third stripline patterns constituting first, second, and third resonant elements, respectively, disposed on a dielectric layer;

a capacitively coupled (C-coupled) pattern disposed between said first and second stripline patterns; and an inductively coupled (M-coupled) pattern disposed between said second and third stripline patterns, wherein the capacitively coupled (C-coupled) pattern comprises a protruding portion extending over a side edge of said second stripline pattern toward said third stripline pattern and disposed separately from said inductively coupled pattern.

3. A laminate filter comprising:

stripline patterns constituting first through fourth resonant elements disposed on a dielectric layer;

a first capacitively coupled (C-coupled) pattern disposed between said first and second stripline patterns;

a second capacitively coupled (C-coupled) pattern disposed between said third and fourth stripline patterns; and an inductively coupled (M-coupled) pattern disposed between said second and third stripline patterns.

4. A laminate filter comprising:

stripline patterns constituting first through fourth resonant elements disposed on a dielectric layer;

a capacitively coupled (C-coupled) pattern disposed between said second and third stripline patterns;

a first inductively coupled (M-coupled) pattern disposed to connect said first and second stripline patterns; and a second inductively coupled (M-coupled) pattern disposed between said third and fourth stripline patterns.

5. The laminate filter set forth in claim 4, wherein protruding portions protruding toward said first stripline pattern and fourth stripline pattern are formed on said capacitively coupled (C-coupled) pattern.

6. A laminate filter comprising stripline patterns constituting first through third resonant elements formed on a first dielectric layer and stripline patterns constituting fourth through sixth resonant elements and formed on a second dielectric layer, the stripline patterns being located opposite to each other with said first or second dielectric layer therebetween, said laminate filter further comprising:

a capacitively coupled (C-coupled) pattern formed opposite to said first, second, fourth, and sixth resonant elements on a third dielectric layer which is disposed between said stripline patterns; and an inductively coupled (M-coupled) pattern respectively disposed between said second and third resonant elements and between said fifth and sixth resonant elements.

7. The laminate filter set forth in claim 6, further comprising: stripline patterns constituting seventh through ninth resonant elements disposed so as to sandwich said first through third stripline patterns and second capacitively coupled (C-coupled) pattern therebetween; and a third inductively coupled (M-coupled) pattern disposed between said eighth and ninth resonant elements.

8. A laminate filter comprising:

first, second, and third microstrip line patterns constituting first, second, and third resonant elements, respectively, disposed on a dielectric layer;

a capacitive coupling (C-coupled) pattern disposed between said first and second microstrip line patterns; and an inductively coupled (M-coupled) pattern disposed between said second and third microstrip line patterns, wherein the capacitively coupled (C-coupled) pattern comprises a protruding portion extending over a side edge of said second micro strip line pattern toward said third micro stripline pattern and disposed separately from said inductively coupled pattern.

9. A filter circuit for providing attenuation bands on low- and high-frequency sides, comprising:

first, second, and third resonant elements, said first and third resonant elements being connected to input and output lines, respectively;

a capacitive parallel resonant circuit which connects the first resonant element and the second resonant element;

an inductive parallel resonant circuit which connects the second resonant element and the third resonant element; and a multipath parallel resonant circuit between the capacitive parallel resonant circuit and the inductive parallel resonant circuit to provide an attenuation band between the low- and high-frequency sides.

10. The filter circuit set forth in claim 9, wherein the first, second, and third resonant elements are constituted by first, second, and third stripline patterns, respectively, disposed on a dielectric layer.

11. The filter circuit set forth in claim 10, wherein the capacitive parallel resonant circuit is constituted by the first and second stripline patterns and a capacitively coupled (C-coupled) pattern disposed therebetween.

12. The filter circuit set forth in claim 10, wherein the inductive parallel resonant circuit is constituted by the second and third stripline patterns and an inductively coupled (M-coupled) pattern disposed therebetween.

13. The filter circuit set forth in claim 9, wherein the first, second, and third resonant elements are constituted by first, second, and third stripline patterns, respectively, disposed on a dielectric layer, and wherein the capacitive parallel resonant circuit is constituted by the first and second stripline patterns and a capacitively coupled (C-coupled) pattern disposed therebetween, said C-coupled pattern having a protrusion toward the third stripline pattern and constituting the multipath parallel resonant circuit.

14. The filter circuit set forth in claim 10, further comprising a fourth resonant element next to the third resonant element, and a second capacitive parallel resonant circuit formed between the third and forth resonant elements.

15. The filter circuit set forth in claim 14, wherein the fourth resonant element is constituted by a fourth stripline pattern, and the second capacitive resonant circuit is constituted by a second capacitively coupled (C-coupled) pattern disposed between the third and fourth stripline patterns.

16. A filter circuit for providing attenuation bands on low- and high-frequency sides, comprising:

first, second, and third resonant elements, said third resonant elements being connected to an output line;

a capacitive parallel resonant circuit which connects the first resonant element and the second resonant element;

an inductive parallel resonant circuit which connects the second resonant element and the third resonant element;

a fourth resonant element next to the first resonant element, said fourth resonant element being connected to an input line; and a second inductive parallel resonant circuit formed between the forth and first resonant elements.

17. The filter circuit set forth in claim 16, wherein the first, second, third, and fourth resonant elements are constituted by first, second, third, and fourth stripline patterns, respectively, and the second inductive parallel resonant circuit is constituted by a second inductively coupled (M-coupled) pattern disposed between the fourth and first stripline patterns.

18. The filter circuit set forth in claim 17, further comprising a multipath parallel resonant circuit between the capacitive parallel resonant circuit and the second inductive parallel resonant circuit.

19. The filter circuit set forth in claim 18, wherein the capacitively coupled pattern has a protrusion toward the fourth stripline pattern and constitutes the multipath parallel resonant circuit.

20. A laminate filter circuit comprising more than one filter circuit of claim 9 laminated on top of the other.

* * * * *